US006908209B2

(12) United States Patent
Miller

(10) Patent No.: US 6,908,209 B2
(45) Date of Patent: Jun. 21, 2005

(54) MINIATURE FLASHLIGHT AND KEYHOLDER

(75) Inventor: Joseph T. Miller, St. Louis, MO (US)

(73) Assignee: Mocap, Inc., St. Louis, MO (US)

( * ) Notice: Subject to any disclaimer, the term of this patent is extended or adjusted under 35 U.S.C. 154(b) by 156 days.

(21) Appl. No.: 10/340,056

(22) Filed: Jan. 13, 2003

(65) Prior Publication Data

US 2004/0190283 A1 Sep. 30, 2004

Related U.S. Application Data

(63) Continuation-in-part of application No. 09/849,410, filed on May 7, 2001, now Pat. No. 6,679,616.
(60) Provisional application No. 60/205,582, filed on May 22, 2000.

(51) Int. Cl.[7] ..... F21L 4/04
(52) U.S. Cl. ..... 362/116; 362/203; 362/206
(58) Field of Search ..... 362/116, 158, 362/189, 201, 203, 204, 206, 202

(56) References Cited

U.S. PATENT DOCUMENTS

| | | | | | |
|---|---|---|---|---|---|
| 1,591,627 | A | | 7/1926 | Hopkins | |
| 2,070,316 | A | | 2/1937 | Recker | |
| 2,143,558 | A | | 1/1939 | Joers | |
| 2,150,644 | A | | 3/1939 | Batcheller | |
| 2,180,228 | A | * | 11/1939 | Florman | 362/203 |
| 2,258,074 | A | | 10/1941 | Swanson | |
| 2,367,888 | A | | 1/1945 | Prideaux | |
| 2,373,306 | A | * | 4/1945 | Gits | 362/203 |
| 2,666,894 | A | | 1/1954 | Babernitsh | |
| 2,694,772 | A | | 11/1954 | Gelardin | |
| 2,737,574 | A | * | 3/1956 | Muller | 362/116 |
| 3,105,233 | A | | 9/1963 | D'Amore et al. | |
| 3,244,871 | A | | 4/1966 | Feldman | |
| 3,532,875 | A | * | 10/1970 | Keller | 362/203 |
| 3,665,178 | A | | 5/1972 | Sussingham et al. | |
| 3,742,207 | A | | 6/1973 | Strauss | |
| 4,109,405 | A | | 8/1978 | Ito | |
| 4,281,368 | A | | 7/1981 | Humbert | |
| 4,303,970 | A | | 12/1981 | Robertson | |
| 4,774,643 | A | | 9/1988 | McGinnis et al. | |
| 4,864,474 | A | * | 9/1989 | Maglica | 362/203 |
| 4,905,129 | A | | 2/1990 | Sharrah | |
| 5,070,437 | A | | 12/1991 | Roberts, Sr. | |
| 5,317,490 | A | | 5/1994 | Miller | |
| 5,370,219 | A | * | 12/1994 | Violett, Jr. | 362/116 |
| 5,567,946 | A | * | 10/1996 | Stevens et al. | 362/189 |
| 5,601,359 | A | | 2/1997 | Sharrah et al. | |

* cited by examiner

*Primary Examiner*—Alan Cariaso
(74) *Attorney, Agent, or Firm*—Paul M. Denk

(57) ABSTRACT

A miniaturized flashlight activated by external pressure by a push stem at one end of its casing, to energize its lamp. The flashlight includes a casing, for holding one or more batteries, and a front cap for holding a lamp contained within the casing, a resilient sleeve that engages the lamp, and likewise engages the front of the located battery, so as to provide for displacement of the lamp from the battery terminal during non-usage, but once the battery is urged forwardly, through pushing of its push stem, provides for illumination of the lamp, as it extends through the front cap for the battery. A rear end cap, just like the front cap, resiliently binds upon the back of the flashlight casing, to hold the light assembled, and a push stem extends through the back of the rear cap, readily available for physical manipulation forwardly to illuminate the light, during usage. An integral tab extends from the rear end cap, and cooperates with a ring, or other holding device, for securing keys or other items to the flashlight.

11 Claims, 2 Drawing Sheets

MINIATURE FLASHLIGHT AND KEYHOLDER

CROSS REFERENCE TO RELATED APPLICATION

This application is a continuation-in-part of U.S. Ser. No. 09/849,410, filed on May 7, 2001 now U.S. Pat. No. 6,679,616, which claims priority upon provisional patent application having Ser. No. 60/205,582, filed on May 22, 2000, all of said applications being owned by a common assignee.

STATEMENT REGARDING FEDERALLY SPONSORED RESEARCH OR DEVELOPMENT

N/A

BACKGROUND OF THE INVENTION

Numerous types of flashlights have been developed, assembled, manufactured, and marketed for some time. In fact, many such flashlights have been made of the miniaturized type, so as to conveniently fit within any available but yet small capacity storage space, such as a glove department in an automobile, in a pocket book, or even in the pocket. One such flashlight is shown in my prior U.S. Pat. No. 5,317,490 relating to an encased flashlight and which is assigned to a common assignee. In the structure of that device, the resiliency of the cap and casing of the back of the flashlight, at the rear end of the battery, contains sufficient resiliency to provide for the contact providing for conduction of the charge, and lighting of its held lamp.

The current invention provides improved means for facilitating in the shifting of the operative components of the flashlight together, but arranging most of the electrical contacting components secured at the frontal end of the flashlight, to assure adequate but sufficient electrical contact for illumination of its light.

Other United States patents showing related type of technology can be seen in U.S. Pat. No. 5,601,359 entitled flashlight having resilience sleeve. This invention includes a resilience sleeve that surrounds the conductive casing, for the light.

U.S. Pat. No. 4,281,368, to Humbert, shows a keyhole illuminating apparatus. This is a small type of flashlight, of the keyhole type, having an ignition button at its back end, for forcing the battery forwardly, and includes means for contacting the biasing spring, surrounding the light, with the casing of the battery, through the usage of a retainer disk.

The early patent to Feldman, U.S. Pat. No. 3,244,871 shows another type of pocket flashlight. It is configured in what appears to be a soda bottle, in its structure.

The United States patent to Swanson, U.S. Pat. No. 2,258,074, shows another form of flashlight. The problem, though, is that its biasing spring is in close contact with the positive end of the battery terminal, and therefore, could easily cause a short during its operations.

Another patent is the U.S. Pat. No. 2,150,644, to Batcheller. This device apparently requires that the entire sleeve of the device shift, in order to cause the lamp to make contact for illumination.

Finally, the patent to Hopkins, U.S. Pat. No. 1,591,627, discloses a hand lamp, which is a more standard appearing type of flashlight, very old in the art.

SUMMARY OF THE INVENTION

This invention relates primarily to a miniaturized flashlight, and more specifically, to a small scale flashlight wherein the various operative components that provide for conduction are associated and secured generally with the frontal end of the flashlight, so as to minimize the amount of pressure and conducted charge needed to achieve electrical contact.

This invention contemplates the formation of a small flashlight, generally one incorporating a single battery, such as a small triple A or double A type of 1.5 volt battery, more or less. Although, the essence of this invention ay be incorporated into flashlights of a larger scale and intensity. The novel flashlight includes a casing, end caps, generally formed of polymer or vinyl, with one of the end caps having an aperture therethrough for projection of a lamp, while the opposite end cap holds the battery in place, within the casing. Furthermore, this last said end cap includes a pressing pin, and likewise, includes an integral sleeve that holds the battery centrally in place, within its casing, so as to prevent any shorting. Thus, the various means provided within the structure of this flashlight, for providing for its actuation, energization, to conveniently space and properly position the operative an electrical components, generally are formed of polymer, or other vinyl, and can function to provide a convenient set of operative components for furnishing the actuation and electrical contact required for operations of this miniaturized flashlight.

Simply by pushing upon the stem extending through the back end cap, the entire battery is forced forwardly, to provide for its ignition. But, the resilient sleeve biasing means that normally maintains the lamp separate from the battery, to achieve a steady state turn-off of the flashlight, likewise provides for positioning, centrally, of the battery along the central axis of the flashlight sleeve. In addition, the rear end cap, which has the ignition stem extending therethrough, provides for centralization of the ignition stem, and likewise, the ignition stem includes an integral sleeve like member that contiguously and snuggly fits onto the battery, also positions its centrally at this location, so as to prevent any shorting for the flashlight as when not in use, or even when it is depressed into an activated position.

It is, therefore, among the objects of the present invention to provide a small flashlight which can be activated into operation through an external compression of a push button or stem, which likewise positions the energization battery centrally within the flashlight casing, when assembled.

Another object of this invention is to provide a miniaturized flashlight that dispenses with the need of any type of mechanical switch for providing for its energization and illumination.

Among the other object of this invention includes a unique biasing resilient member that tightly secures upon the upper front edge of the battery, and extends forwardly, for separating the light contact terminal from the upper end of the battery, so as to sustain the flashlight normally inoperative, as when not in use.

Yet another object of this invention is to provide such a flashlight incorporating a key retainer ring on one end.

Still another object of this invention is to provide a flashlight fabricated from various non metallic components, such as polymer, and vinyl, acrylics, and other non conducting parts that make up the miniature flashlight of this invention.

Still another object of this invention is to provide for a miniaturized flashlight which is fabricated from various resilient and polymer or rubber like components, and which are easy to assemble during usage, due to their expandable qualities, to afford the necessary contact, when subjected to pressure, to provide for illumination of its light, when assembled for usage.

Yet another object of this invention is to provide a flashlight with relatively few parts that is very easy to assemble during the manufacturing process.

Still another object of this invention is to provide a miniaturized flashlight that can function quite beneficially as a consumer promotional product.

These and other objects will become more apparent to those skilled in the art upon review of the summary of the invention as provided herein, and upon undertaking a study of the description of its preferred embodiment, in view of the drawings.

DESCRIPTION OF THE PREFERRED EMBODIMENT

Figure 1:
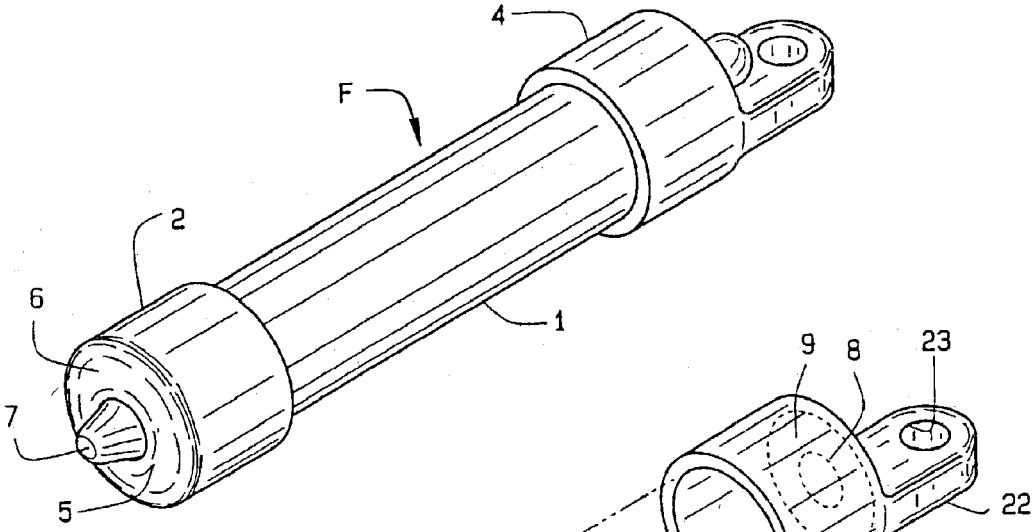
FIG. 1 is a perspective view of the miniature flashlight and keyholder of this invention.
Figure 1:
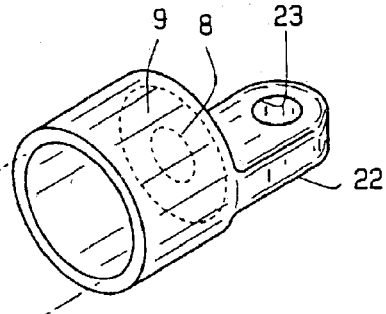
Figure 2:
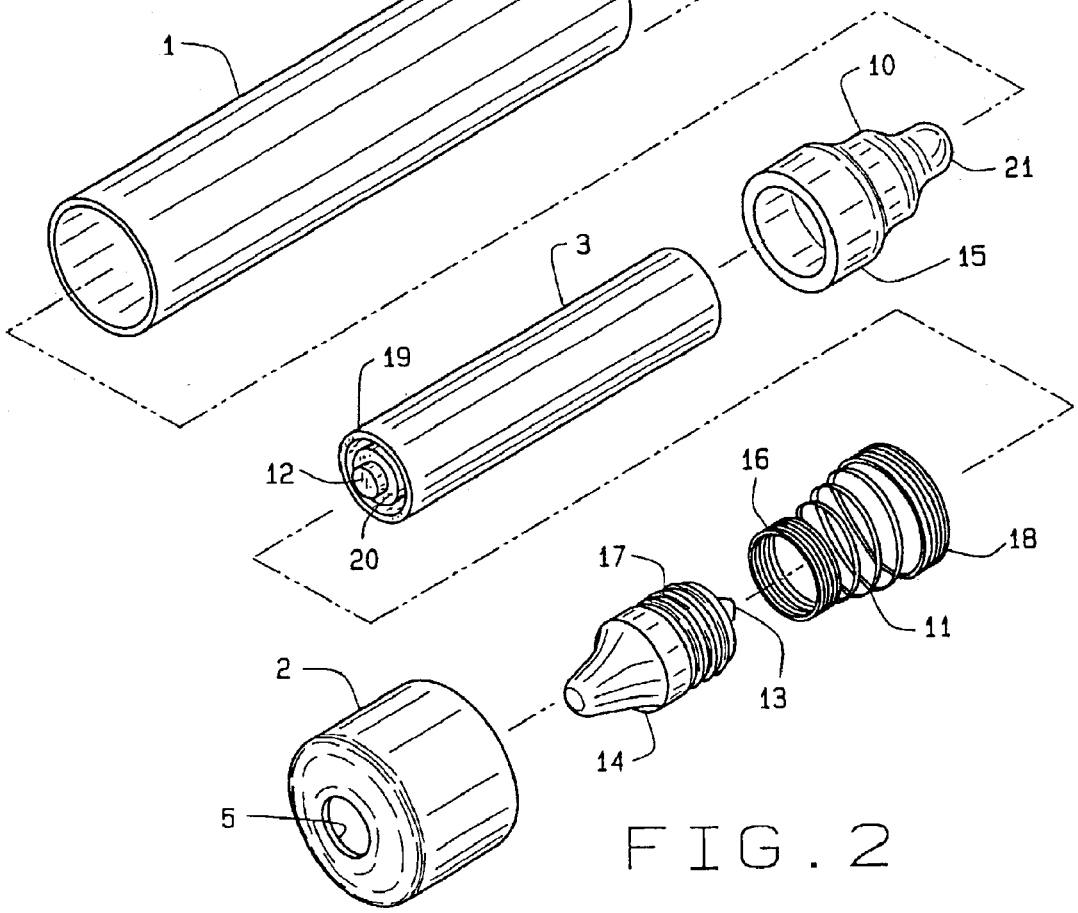
FIG. 2 is an exploded view of the various components aligned for assembly when the miniature flashlight of this invention is assembled.

In referring to the drawings, and in particular FIG. 1, the flashlight F of this invention is readily disclosed. It includes a body or casing 1 which may be fabricated of any type polymer, and either be transparent, or have coloration, in its structure. Preferably, the casing will also be fabricated of a polymer, or vinyl, or other non conductive material. The casing is made of a tubular material, with an inner bore, having a length somewhat greater than the combined length of the base of the lamp or frontal portion 2, the battery 3 enclosed within the casing, in addition to the back end closure 4, as can be noted. Generally, and preferably, all of these components will be made of a polymer material, although it may be fabricated from other tubular or sleeve type stock material, when made. The forward end of the casing 1 includes the closure or front cap 2, which can be integral, or a cap as shown, and which has an aperture 5 provided therethrough, formed through its front wall 6, so as to allow for projecting forwardly of the lamp 7, to provide for its ready observance and illumination, when the flashlight is energized. This front cap will be made of a resilient type of polymer, such as a vinyl, so that it can be snugly inserted and applied to the front of the casing 1, when the flashlight is assembled, and have sufficient tenacity so as to provide for the cap to remain fixed, to the front, unless it is forcefully removed.

At the back end of the flashlight is the rear closure or cap 4, as aforesaid that tightly embraces upon the back end of the shown casing 1, of the flashlight, when assembled. The rear closure or cap 4, just like the front cap 3, may be fabricated of any type of resilient polymer, such as a vinyl, in order to allow for its tight fitting relationship upon the back end of the casing, when assembled, as can be understood.

In addition, there is an aperture 8 provided through the back wall 9 of the rear cap 4, and through this aperture 8 extends the push stem 10 that allows for the battery 3 to be shifted forwardly, against the bias of the resilient sleeve 11, thereby allowing contact with the terminal 12 of the battery with the back end 13 of the lamp 14, to provide for its illumination. But, when the push stem 10 is released, and the bias of the resilient sleeve 11 forces the battery 3 and the push stem 10 rearwardly, this disengages the electrical contact, allowing for the lamp to turn off, as can be understood.

One of the unique advantages of this invention is that the push stem 10 has a forwardly extending integral portion 15 that resiliently connects onto the back of the battery 3, to embrace it, hold it centrally located within the casing 1, upon installation.

A further uniqueness of this invention, in addition to utilizing the type of push stem 10 as described, is that the electrical aspect of this flashlight are embodied primarily at its frontal portion, through the arrangement of the resilient sleeve 11, which has a unique design, and which provides all the electrical contact needed, at the front of the battery, to achieve illumination, or turn off, of its lamp 14. For example, the front 16 of the sleeve 11 is designed to tightly engage onto the threaded end 17 of the lamp, as can be understood. The back of the sleeve, as at 18, is designed for tightly embracing around the front edge 19 of the battery, as so to keep it centralized, in its location within the casing 1. Hence, since batteries of this type normally have a metal clad outer surface, which wraps around the back end of the battery, but that the metal clad surface is isolated from the terminal 12, by means of the insulator 20, once the resilient sleeve is located upon the lamp 14, and also arranged upon the front edge of the battery jacket, as explained, the only contact that need to be made to illuminate the light is the contact of terminal 12 of the battery with the contact point 13 of the lamp, as understood.

Hence, through the combination of the resilient sleeve 11, and the push stem 10 that embrace both the frontal and the back ends of the battery, the battery is maintained centralized within the casing 1, once installed, and throughout the time the flashlight is utilized.

In the fabrication of this flashlight, it should obviously be recognized that either one, two, or more batteries can be used within the light, so as to enhance its intensity, and this all depends upon the length of the casing 1, as used in its structure. In addition, and other than the arrangement of the battery(s) 3 within the flashlight, all of its components may be made of a polymer, which makes it particularly useful when fabricating the flashlight as a specialty or promotional item, since polymers can be doped with a variety of brilliant colors, have advertising indicia applied thereto, and are readily acceptable for use for that particular purpose, when assembled.

Furthermore, the unique structure of the push stem 10, which provides a rear stem portion 21 that projects through the aperture 8, of the rear end cap, and then the push stem expands into a wider dimension, for forming the embracing sleeve 15, that grasp onto and holds in place the back of the battery 3, adds to the integrity of this flashlight, when fabricated, and used. This prevents any shorting from occurring.

Furthermore, as can be noted the structure of the rear end cap, which includes an integral extending tab 22, which incorporates an aperture 23 therethrough, and through which a key ring, or the like, may locate, for holding keys, so this particular item can also be used as a key holder, when employed. These are all advantages obtained from the fabrication of this polymer miniaturized flashlight, when assembled for usage.

Figure 3:
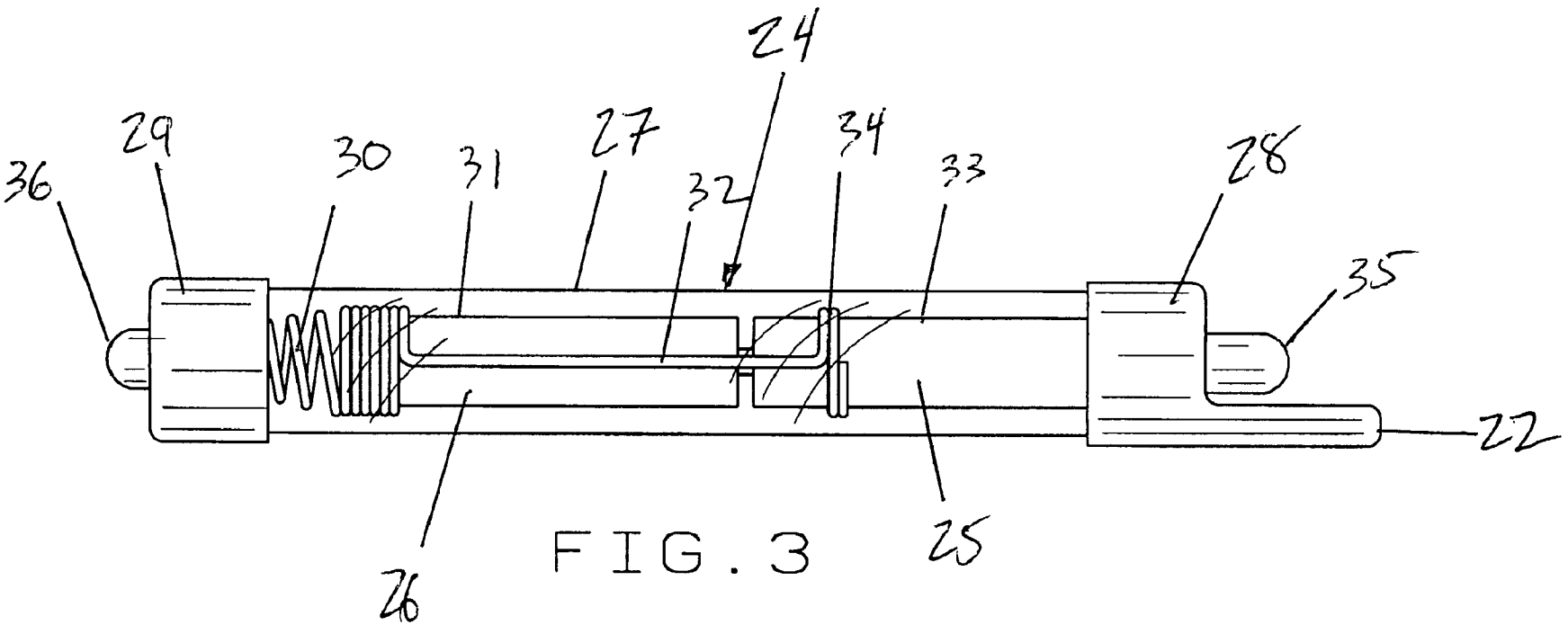
FIG. 3 shows a side view of the flashlight of this invention containing multiple batteries.

FIG. 3 discloses a variation to the flashlight 24 of this invention. As shown, the flashlight includes the usual components as previously described for this particular invention.

But in this modification, there are a pair, or more, of batteries 25 and 26 contained in the casing 27. The back end closure 28 is formed in the manner as described for the closure 4, previously, while the front cap 29 is the same as previously described. In this particular instance, the spring 30 engages the lamp, along its base, in the manner as previously defined, but the spring, or resilient sleeve, as shown, not only engages the outer jacket of the battery 26, as can be noted at 31, but further includes an extension 32 that extends rearwardly, and likewise tightly engages the outer jacket 33 of the battery 25, by means of the formed spiral 34. In this manner, electrical contact is provided for all of the batteries, to the base of the lamp, and when the batteries are urged forwardly, as by a manual push exerted upon-the stem 35, electrical contact is made with the back end or electrode of the lamp 36, to illuminate said lamp. Obviously, if more than two batteries are applied within the flashlight, similar type of contact will be made through the usage of the spring 30, in the manner as shown herein. It may just require further extensions 31, to attain such contact with supplementally aligned batteries.

Variations or modifications to the subject matter of this invention may occur to those skilled in the art upon reviewing the disclosure as provided herein. Such variations, or modifications, if within the scope of the invention as defined herein, are intended to be encompassed within the scope of the claims to invention made for this assembly. The description of the preferred embodiment, in addition to their depiction in the drawings, is provided for illustrative purposes only.

I claim:

1. A flashlight comprising:

a casing having an inner bore;

a front end cap having a wall with an opening formed therein, said front end cap applied at the first end of the casing;

a lamp within the bore of the casing at the first end thereof and extending out of said opening through the front end cap at the front end of the casing, and at least one battery provided within the casing;

a resilient sleeve connecting with the lamp, and further connecting with the front end of the battery, to normally bias the lamp away from the battery terminal;

a resilient rear end cap connecting with the back end of the casing, and having a push stem extending therethrough, said push stem engaging the back end of the battery, and upon its depressing, biasing the battery into contact against the resiliency of said resilient sleeve to provide electrical contact for illuminating the lamp; and, a tab extending from the rear end cap and cooperating with a ring;

whereby, the ring holds keys.

2. The flashlight of claim 1 wherein the compression of the resilient sleeve provides for electrical contact between the battery and the lamp.

3. The flashlight of claim 1 wherein the casing is formed from a polymer.

4. The flashlight of claim 1 wherein the front and rear end caps are formed of polymer.

5. The flashlight of claim 4 wherein the polymer is a resilient vinyl.

6. The flashlight of claim 1 wherein the front end cap is hollow, said front end cap tightly adhering to the outer surface of said casing proximate to the first end of the flashlight casing, said front end cap providing for extension of the lamp therethrough during installation.

7. The flashlight of claim 6 wherein the rear end cap has an integral back wall, a further sleeve integrally formed with the back wall, said sleeve resiliently and tightly biasing upon the flashlight casing, said wall of the rear end cap having an aperture therein for extension of said push stem therethrough and providing for exposure of the stem for manual urging of the flashlight into illumination.

8. A flashlight comprising:

a casing having an inner bore;

a front end cap having a wall with an opening formed therein, said front end cap applied at the first end of the casing;

a lamp within the bore of the casing at the first end thereof and extending out of said opening through the front end cap at the front end of the casing, there being a plurality of batteries provided within the casing;

a resilient sleeve connecting with the lamp, and further connecting with the front end of said plurality of batteries, to normally bias the lamp away from the terminal at the front end of said plurality of batteries; and, a resilient rear end cap connecting with the back end of the casing, and having a push stem extending therethrough, said push stem engaging the back end of the batteries, and upon its depressing, biasing the batteries into contact against the resiliency of said resilient sleeve to provide electrical contact for illuminating the lamps.

9. The flashlight of claim 8 wherein said resilient sleeve includes an extension, said extension contacting the outer surface of each battery, and providing for electrical contact of each battery with the lamp, to provide for illumination of the lamp energized from all of the batteries upon depressing of the push stem against the back end of the series of batteries.

10. A flashlight having a cylindrical casing; a front end cap having a wall with an opening formed therein, said front end cap applied at the front end of the casing; a lamp within the casing at the front end thereof and extending out of the opening through the front end cap at the front end of the casing; at least one battery provided within the casing; and, a resilient rear end cap connecting with the back end of the casing, and having a push stem extending therethrough, said push stem engaging the back end of a battery; wherein the improvement comprises:

a resilient sleeve within said casing, connecting with the lamp, and further connecting with the outer surface of the front end of a battery, to normally bias the lamp away from the battery terminal, whereupon depressing said push stem biases the outer surface of the battery into contact against said resilient sleeve thus completing electrical contact to illuminate the lamp; and, a tab extending from the rear end cap and cooperating with a ring;

whereby, the ring holds keys.

11. A flashlight having a cylindrical casing; a front end cap having a wall with an opening formed therein, said front end cap applied at the front end of the casing; a lamp within the casing at the front end thereof and extending out of the opening through the front end cap at the front end of the casing; at least two batteries provided within the casing; and, a resilient rear end cap connecting with the back end of the casing, and having a push stem extending therethrough, said push stem engaging the back end of the batteries; wherein the improvement comprises:

a resilient sleeve within said casing, connecting with the lamp, and further connecting with the outer surface of the front most battery, to normally bias the lamp away from the battery terminal, including an extension of said resilient sleeve for contacting the outer surface of each battery, and providing for electrical contact of each battery with the lamp, whereupon depressing the push stem against the back end of the rear most battery provides for illumination of the lamp energized from all of the batteries; and, a tab extending from the rear end cap and cooperating with a ring;

whereby, the ring holds keys.

* * * * *